US005262793A

United States Patent [19]

Sperry

[11] Patent Number: 5,262,793

[45] Date of Patent: Nov. 16, 1993

[54] LOW PROFILE TELEVISION ANTENNA FOR VEHICLES

[75] Inventor: Randy L. Sperry, Mediapolis, Iowa

[73] Assignee: Winegard Company, Burlington, Iowa

[21] Appl. No.: 793,868

[22] Filed: Nov. 18, 1991

[51] Int. Cl.[5] ..... H01Q 1/32

[52] U.S. Cl. ..... 343/713; 343/795

[58] Field of Search ..... 343/713, 711, 714, 795, 343/823

[56] References Cited

U.S. PATENT DOCUMENTS

| | | | |
|---|---|---|---|
| 2,555,857 | 6/1951 | Nelson et al. | 343/795 |
| 2,559,148 | 7/1951 | Ercolino | 343/795 |
| 4,028,709 | 6/1977 | Berkowitz et al. | 343/823 |
| 4,663,633 | 5/1987 | Wilson | 343/714 |
| 4,794,399 | 12/1988 | Sensibaugh | 343/882 |

OTHER PUBLICATIONS

Owner's Manual—Carefree of Colorado, Broomfield, Colo., Jun. 1988.

Owner's Manual/Installation Instructions—Winegard RV Antenna, Copyright 1991.

*Primary Examiner*—Donald T. Hajec
*Assistant Examiner*—Tan Ho
*Attorney, Agent, or Firm*—Dorr, Carson, Sloan & Peterson

[57] ABSTRACT

A low profile, compact television antenna for use on vehicles such as recreational vehicles. The antenna of the present invention uses snap-fastening assembly for ease of assembly and disassembly. The overall profile of the antenna has been reduced to two inches to reduce the effects of wind resistance against the antenna as the vehicle on which it is mounted is moved. The antenna also has improved stability. The angle of bend of the wing tips of the antenna wings have also been reduced to reduce the overall profile and to reduce oscillation of the wing tips against the roof of the vehicle. The antenna of the present invention also includes an integral leveling block for engagement with an antenna support boom. The leveling block is integrally molded with the housing to provide a stronger, lighter weight, more compact structure than the prior separable leveling blocks.

3 Claims, 7 Drawing Sheets

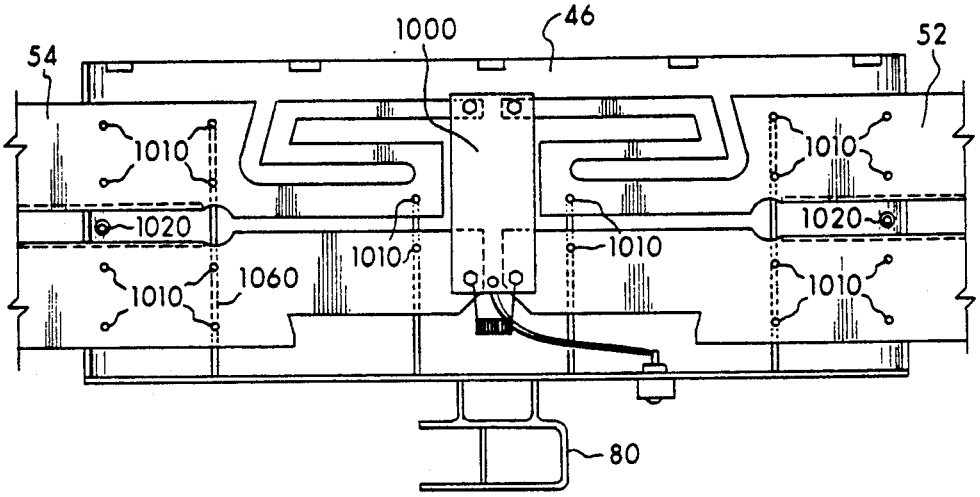
Fig. 10(a)
Fig. 11
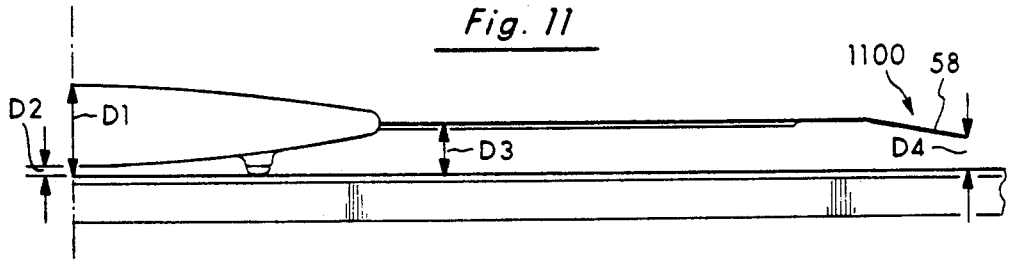
Fig. 12
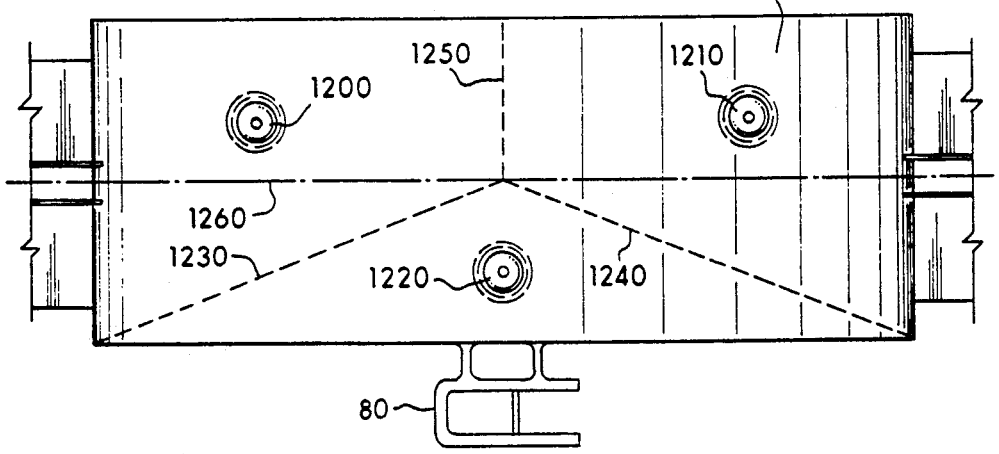

LOW PROFILE TELEVISION ANTENNA FOR VEHICLES

BACKGROUND OF THE INVENTION

1. Field of the Invention

This invention relates to the field of antennas, particularly external low profile television antennas for recreational vehicles.

2. Statement of the Problem

Operators of recreational vehicles often desire television facilities in their recreational vehicles (RVs). A number of television antennas which are externally mountable onto the roofs of recreational vehicles are commercially available. One such antenna is the SENSAR ® antenna, manufactured by the Winegard Company, Burlington, Iowa. A similar SIGNAL COMMANDER ® antenna is also marketed for use on recreational vehicles. Both antennas typically include two antenna wings having bent wing tips and a central housing encasing the electronics of the antenna and a portion of each of the antenna wings. The housing includes a leveling block bolted onto the rear of the housing which is attached to a boom which is used to position the antenna with respect to the roof of the RV. The antenna is lowered down onto the roof of the recreational vehicle prior to movement.

The prior art antennas encounter wind resistance during movement of the recreational vehicles. This may cause fatigue damage to the antenna as well as increase the wind resistance of the recreational vehicle. Also the wind load can cause oscillation of the wing tips of the antenna against the top of the roof of the recreational vehicle, causing possible damage or indentation as well as possible damage to the control housing.

The SENSAR ® recreational vehicle antenna 20 is illustrated in FIGS. 2 and 3. Antenna 20 includes upper housing section 22, and lower housing section 24. Housing sections 22, 24 are fastened together along line 25 by separate fasteners (not shown) and by ultrasonic welding. This type of assembly is complicated and is difficult to disassemble for repair or testing purposes. Housing sections 22, 24 have a final height of about four inches. Antenna wings 26*a*, 26*b* extend outward from the housing sections 22, 24 to wing tips 27*a*, 27*b* having a pronounced downward bend. Two base members 30 (only one shown in FIG. 3) extend downward from lower housing section 24 to provide footing against the roof of the RV. Leveling block 34 is a separate part and is mounted during manufacturing onto the rear of the antenna housing by fasteners 36, 38. An antenna support boom (not shown) is connected to the leveling block to move the antenna to an upward or lowered position. This antenna has a profile which causes wind resistance as the recreational vehicle is moved. The two base members 30, which enable the housing section 24 to rest on the roof 50 during movement of the RV or during non-use of the antenna, provide some stability of the antenna against the roof of the recreational vehicle when the antenna is lowered and the recreational vehicle is moving. In the lower position, however, chattering of the wing tip ends against the roof 50 may occur. As shown in FIG. 3, the wing tip end 27 does not touch the roof 50 when lowered.

One prior recreational vehicle antenna is illustrated in FIG. 1 and is sold under the trademark SIGNAL COMMANDER. This antenna 10 uses a bonding process to firmly fasten the control housing sections 12, 14 together at line 17. Antenna wings 11*a*, 11*b* extend outwardly to tips 13*a*, 13*b*. Further, antenna 10 encounters wind resistance due to the raised structure 16, 18 on housing sections 12, 14. This antenna requires a separate leveling block mounted in area 15 and also requires additional fasteners to mount the antenna on to the antenna support boom which is done by the customer on installation. This antenna also rests onto a separate travel bracket, not shown, which affixes to the roof of the RV.

Such prior antennas are normally assembled using multiple fasteners, adhesives or ultrasonic welding of the central housing sections. This type of construction increases the weight of the antenna, due to the multiple fasteners, and/or requires a complicated process of assembly and disassembly of the housing—all adding to the cost of the antenna.

A need also exists to place the central housing of the antenna as close as possible (i.e., to hug) the roof of the RV. This will also lower wind resistance. However, lowering the central housing to the roof must be done in a fashion without increasing the wing-tip damage to the roof.

Thus a need exists for a low profile, lightweight antenna that hugs the RV roof and is stable under wind load. An antenna having simple construction that can easily be assembled during manufacturing and that can easily be disassembled during warranty for repair. With hundreds of thousands of RVs requiring those types of antennas, the need to minimize roof damage, to manufacture antennas with less parts and more efficiently, and to repair such antennas in less time becomes critical.

3. Solution to the Problem

The present invention solves these and other problems by providing an external low profile television antenna for RV vehicles. The antenna of the present invention has a compact, aerodynamically shaped, low profile which hugs the RV roof to further reduce the wind resistance as the RV moves.

The present invention provides an antenna housing having a lower profile to further reduce wind resistance as well as to reduce the profile of the outwardly extending antenna wings.

The present invention also provides a more stable base for further reducing the oscillation of the antenna against the roof during movement of the recreational vehicle.

The present invention also provides for further minimizing the need for multiple fasteners.

The present invention also provides a leveling block that is stronger and lighter in weight which is integral to the housing so as to eliminate the need for an extra component part.

These and other solutions to the problems associated with the prior art recreational vehicle antennas will be evident from the ensuing description of the invention and from the drawings.

SUMMARY OF THE INVENTION

The present invention provides an external low profile, compact television antenna for use on recreational vehicles. The antenna of the present invention is easy to assemble and to disassemble. The antenna is lightweight and strong.

In one preferred embodiment of the present invention, the antenna includes an upper housing section and a lower housing section having resilient tabs and slots as well as guide posts with guide holes which engage one another to secure the sections together over the electronics of the antenna as well as over portions of the antenna wings. The snap-together assembly of the sections eliminates the need for multiple fasteners and for adhesive bonding or ultrasonic welding of the sections together. The housing can be quickly assembled without complicated equipment as well as disassembled for repair or testing as needed. In a second embodiment, the antenna of the present invention uses ultrasonic welding to affix the two sections together.

The overall profile of the antenna in comparison to the design of FIG. 2, has been reduced to about two inches to reduce the effects of wind resistance of the antenna as the vehicle on which it is mounted is moved. The angle of bend of the wing tips of the antenna wings have also been reduced, to about ten degrees, to minimize the overall profile of the antenna and to further prevent the striking of the wing tips against the roof of the vehicle when the antenna is in the lowered position.

A plurality of two or more low profile resilient base members are mounted on the bottom of the antenna housing in an evenly spaced pattern to increase the stability of the antenna against the roof of the vehicle when the antenna is in the lowered position. The base members are snapped into the lower housing to eliminate the need for additional fasteners.

The antenna of the present invention also includes an integral leveling block for engagement with an antenna support boom. The leveling block is integrally molded with the housing to provide a stronger, lighter weight, more compact structure and which is less expensive to manufacture than the prior separable leveling blocks.

Thus, the present invention provides a compact, lightweight antenna that has a lower profile to reduce wind resistance and increase stability in the lowered position. This antenna is also easier to assembly and allows ease of disassembly. These and other features of the invention will be disclosed in the ensuing detailed description of a preferred embodiment in conjunction with the drawings.

BRIEF DESCRIPTION OF THE DRAWING

FIG. 10(*b*) is a cutaway view of the upper housing section of the antenna;

FIG. 10(*c*) is cross sectional view showing the guide posts of the housing of the antenna;

FIG. 11 is a cross sectional view of the front of the antenna displaying the height ratios of the antenna;

FIG. 12 is a bottom view of a second embodiment of the present invention.

DETAILED DESCRIPTION OF A PREFERRED EMBODIMENT

The present invention provides an external, low profile antenna for vehicles such as recreational vehicles and the like, to receive television signals. The present invention is designed to further minimize wind resistance and to provide greater stability over prior RV antennas. Also, the present invention provides a more lightweight, compact antenna that is more easily and less expensively assembled and disassembled.

One preferred embodiment of the present invention is illustrated in FIGS. 4–11. It is to be expressly understood that the present invention is not to be limited to the descriptive embodiment which is discussed in detail for explanatory purposes only. Other embodiments and modifications are considered to be within the scope of the inventive concept. For example, the outer design of the housing can take on many configurations under the teachings of the present invention.

1. Connection of Housing Sections 44 and 46

Figure 4:
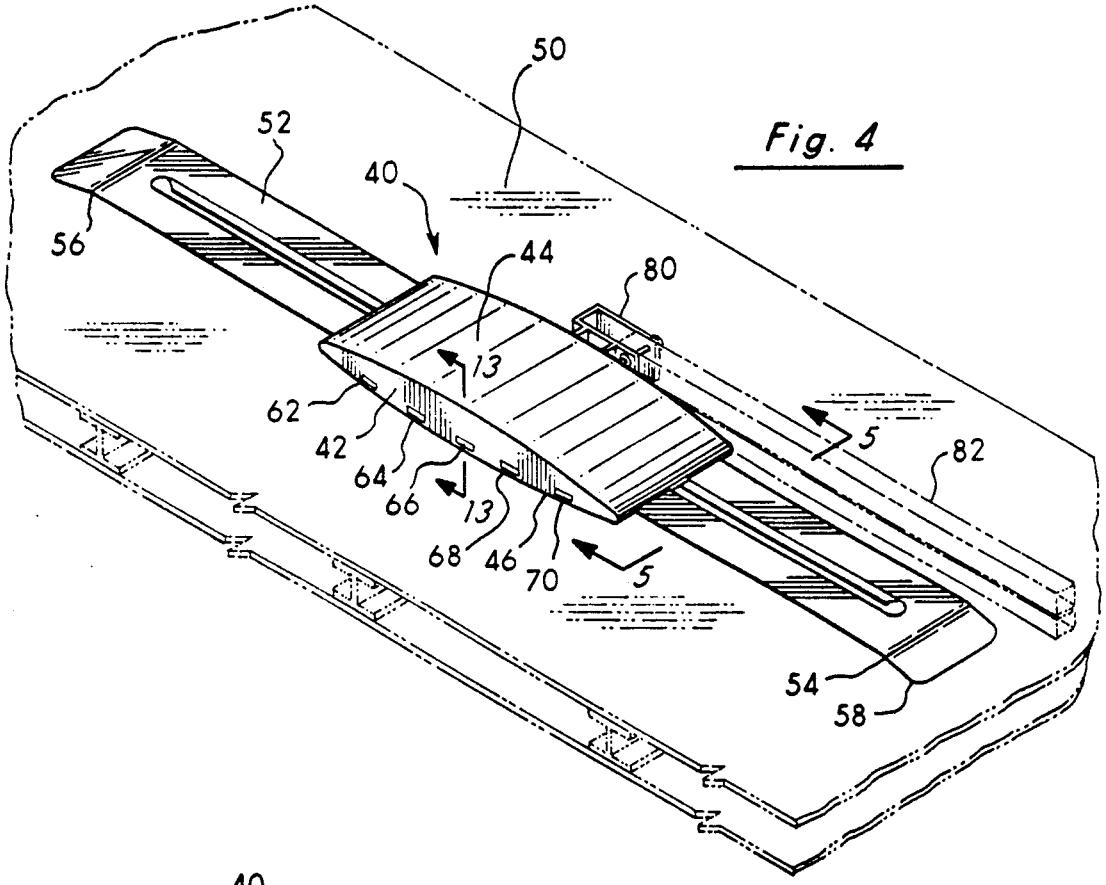
FIG. 4 is a perspective view of a preferred embodiment of the antenna of the present invention.
Figure 5:
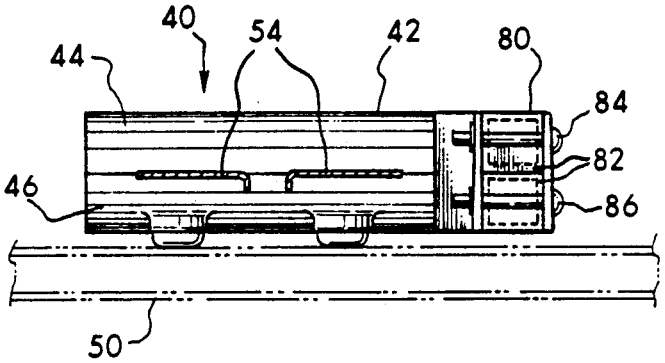
FIG. 5 is a cross sectional view of the antenna of FIG. 4.

Antenna 40, shown in FIG. 4, includes housing 42 having upper housing section 44 and lower housing section 46. Housing sections 44, 46 are formed from molded plastic for durable lightweight performance. In the preferred embodiment, housing 42 has a maximum height at the center of the housing of two and one/eight (2.125) inches, with a length of sixteen (16) inches and a width of six (6) inches. Housing 42 has a low profile, smooth, substantially elliptically contoured shape to reduce wind resistance when the antenna is lowered against roof 50 of the recreational vehicle. Mounted within the housing is a printed circuit board 1000 shown in FIG. 10 to receive the television broadcast signals. Printed circuit board 1000 does not form a part of this invention and is not discussed herewith.

Figure 1:
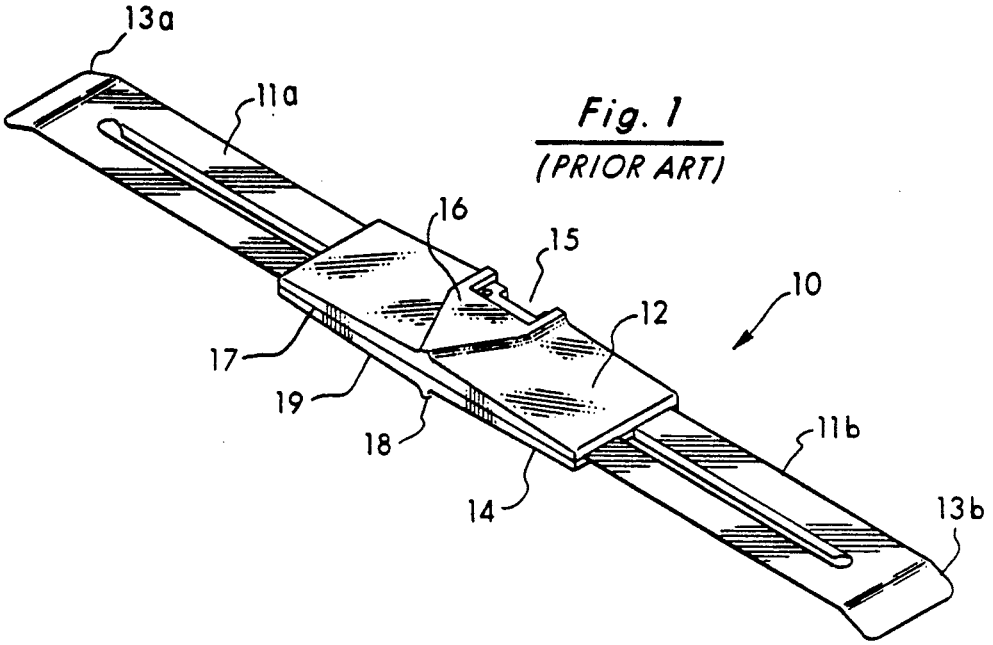
Fig. 1 (PRIOR ART)
FIG. 1 illustrates a prior art antenna for recreational vehicles.
Figure 2:
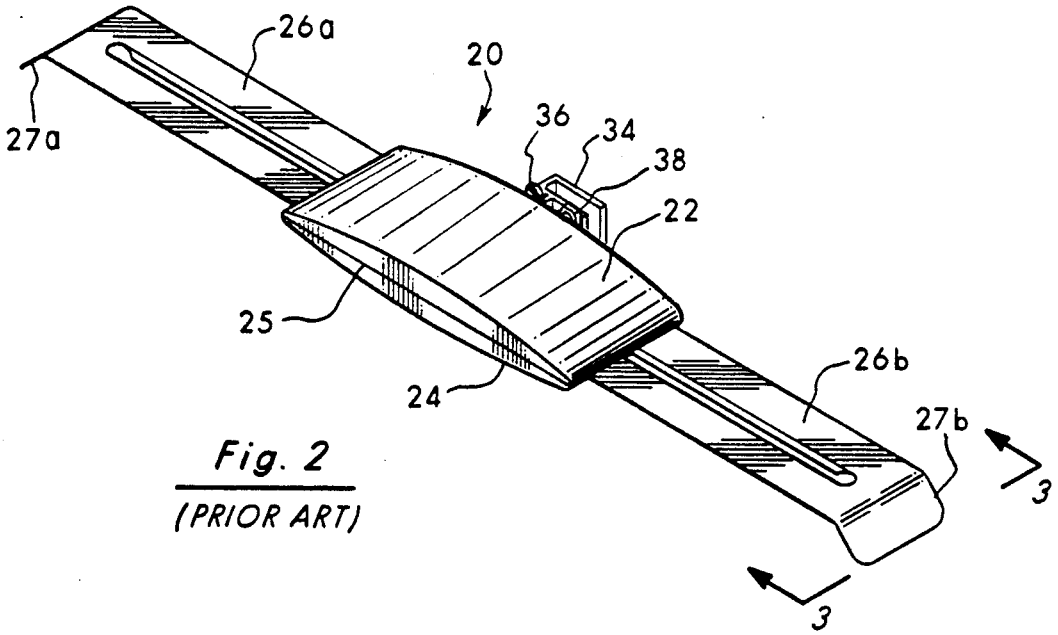
Fig. 2 (PRIOR ART)
FIG. 2 illustrates another prior art antenna for recreational vehicles.
Figure 8:
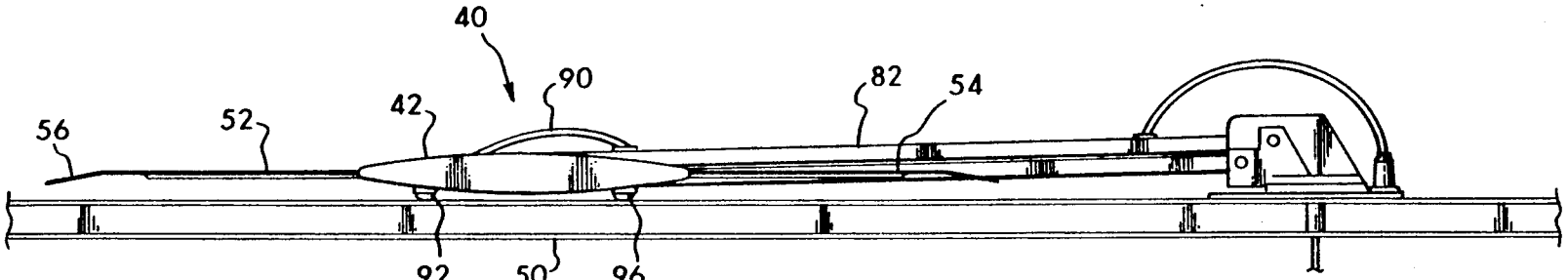
FIG. 8 is a front view of the antenna of FIG. 4 in a lowered position.
Figure 10B:
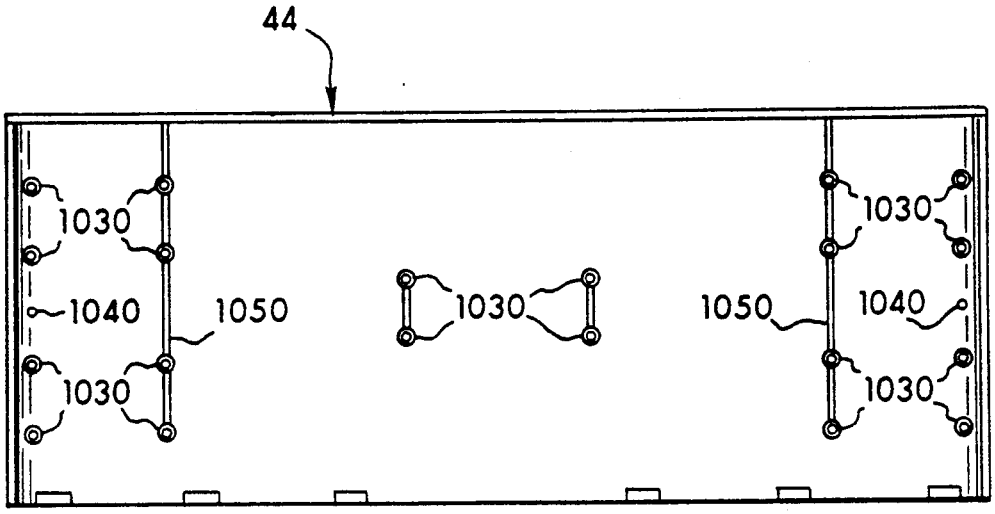
FIG. 10(*a*) is a cutaway view of the lower housing section of the antenna.
Figure 10C:
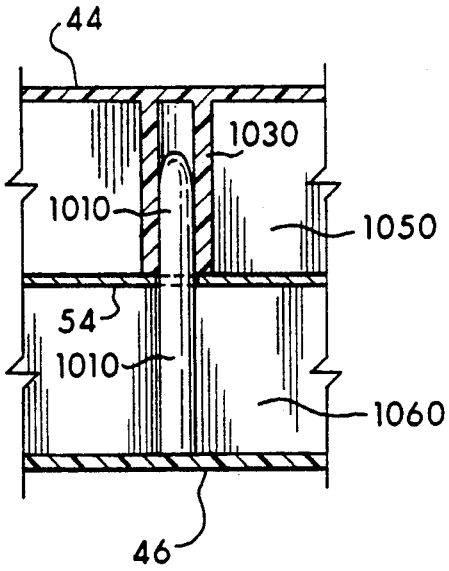

Antenna wings 52, 54 extend outwardly from housing 42 on each side of the housing as shown in FIGS. 4, 8, 10. Wing tips 56, 58 extend downward from the ends of wings 52, 54, respectively, at an angle of about ten degrees. This is in comparison to an angle of about thirty degrees for the antennas of FIGS. 1 and 2. The range of the antenna wing tip angles is from approximately seven to ten degrees. This provides the maximum satisfactory aerodynamic stability for the antenna wings.

Figure 3:
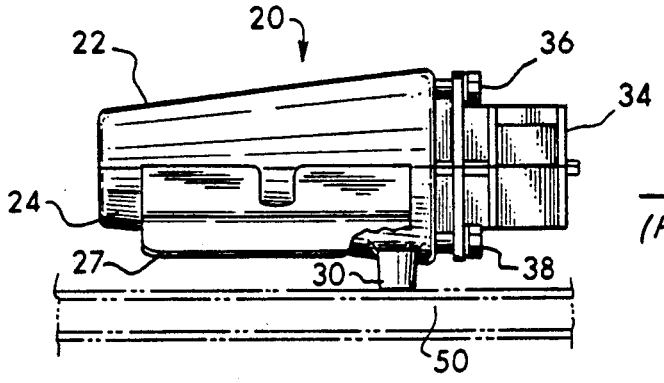
Fig. 3 (PRIOR ART)
FIG. 3 is an end view of the prior art antenna of FIG. 2.

Upper housing section 44 and lower housing section 46 are securely fastened over portions of wings 52, 54 by slots 62–70 formed in the front surface of lower housing section 46 which engage tabs formed in the front surface of upper housing section 44. Similar tabs and slots are formed on the rear surfaces of upper housing section 44 and lower housing section 46 and engage one another in a similar fashion. The front and rear surfaces of the housing sections are resilient to enable the slots to engage over the tabs. Further, as shown in FIGS. 10(*a*) and 10(*b*), guide posts 1010 and guide holes 1020 of lower housing section 46 engage in opposing guide holes 1030 and guide posts 1040 of upper housing section 44. The guide posts 1010, 1040 and guide holes 1020, 1030 align housing sections 44, 46 into proper position as well as retain antenna wings 52, 54 into place relative to upper housing section 44 and lower housing section 46. Reinforcing walls 1050, 1060 extending between the guide posts and guide holes provide stiffening to the housing sections to reinforce the housing sections. The housing sections are thus able to be securely fastened together without the use of adhesive bonding, ultrasonic welding or the use of multiple fasteners. Housing 42 can also be easily disassembled without destroying the housing to allow for repair or testing of the antenna. The tabs, in a second embodiment, can also be glued or ultrasonically welded, if preferred, to provide further stability between housing sections 44, 46 during use. This approach results in the elimination of sixteen fasteners in the SENSAR ® antenna of FIGS. 2 and 3 which is a savings in manufacturing costs and inventory. This compares to eleven molded snap fasteners of the present invention.

Figure 13:
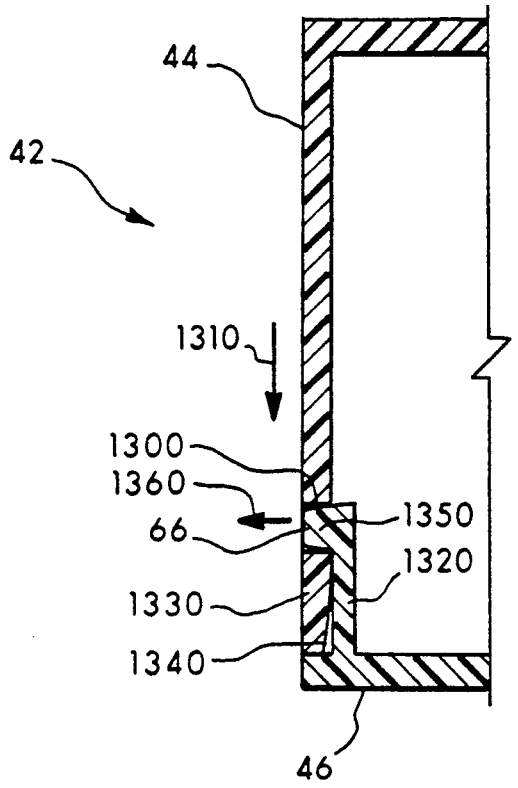
FIG. 13 is a side cross-sectional view showing the unique top and slot arrangement for connecting the housing sections of the present invention together.

In FIG. 13, the details of the tab and slot design of the present invention are set forth. Housing 42 comprises upper section 44 and lower section 46. With respect to connection 66, the upper section 44 has a formed slot 1300 which receives tab 1350 to lock the upper section 44 to the lower section 46. The sections quickly mount together. Section 44 is moved in direction of arrow 1310 towards section 46. When end 1340 hits the portion 1350, the end 1340 moves outwardly 1360 over portion 1350. A taper 1340 is provided to facilitate in the outward movement Portion 1330 then moves downwardly to snap into place. Portion 1320 is offset sufficiently so that when 1330 is in locking position, housing sections 44 and 46 have their external surfaces in the same plane.

2. Leveling Block 80

Figure 6:
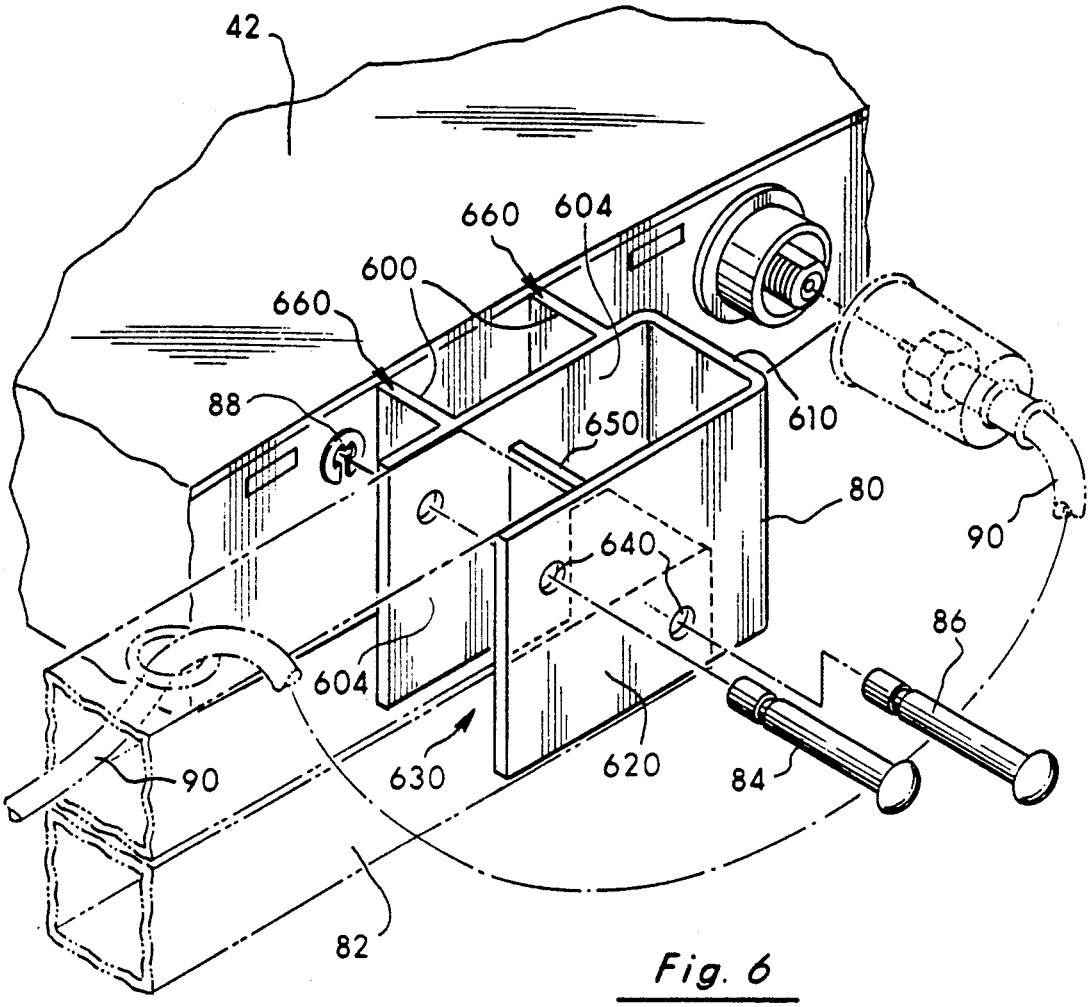
FIG. 6 is a rear view of the antenna of FIG. 4 showing the antenna leveling block.

Leveling block 80, shown in FIGS. 4–7, is integrally formed onto the rear of housing 42 on section 46. An antenna support boom 82, as is known in the art, is secured to leveling block 80 by two clevis pins 84, 86 and snap fasteners 88. It is to be understood that any suitable means could be used to secure the leveling block to boom 82. Antenna 40 is raised and lowered by movement of boom 82 as well as rotated to receive television broadcast signals. Again, this is conventional, as shown in FIG. 6, leveling block 80 includes two outwardly extending members 600 having an integral connection at 660 with housing 42. This integral connection not only eliminates the need for separable fasteners and the associated weight and assembly costs, but allows a much more compact and aerodynamic leveling block and housing structure. The leveling block, unlike prior approaches, cannot work loose from the antenna 42. Inner wall 604, perpendicular side wall 610 and outer wall 620 integrally form a U-shaped bracket 630 integrally mounted on the outward ends of members 600. This one-piece structure forms a mounting bracket for antenna support boom 82. Partition 650 is formed partially across a mid-portion of bracket 630 to provide a stop for the upper portion of support boom 82. Support boom 82 is secured to leveling block 80 by pins 84, 86 inserted through holes 640 in leveling block 80 and mating holes in support boom 82. Clips 88 engage in grooves on pins 84, 86 to secure support boom 82 on leveling block 80 while allowing the members of boom 82 to pivot relative to the antenna housing. The eccentric placement of holes 640 and the differing lengths of the members of boom 82 cause the antenna to remain horizontal as the boom 82 moves to a vertical position perpendicular to the roof of the vehicle. Again, this feature is of conventional design. Thus, the present invention provides an antenna having an attachment apparatus that is lighter weight, more cost-effective and more aerodynamic than the separable prior art leveling blocks of the antenna in FIG. 2. The leveling block 80 is of the same height as the housing 42. The integral design results in a substantial savings in inventory and assembly costs since 4 bushings, 4 washers, 4 nuts, and 2 U-bolts are eliminated.

Coaxial cable 90 connects into housing 42 in a well known fashion to conduct the received signal from the antenna into the television set within the recreational vehicle.

3. Base Members 92–98

Figure 7:
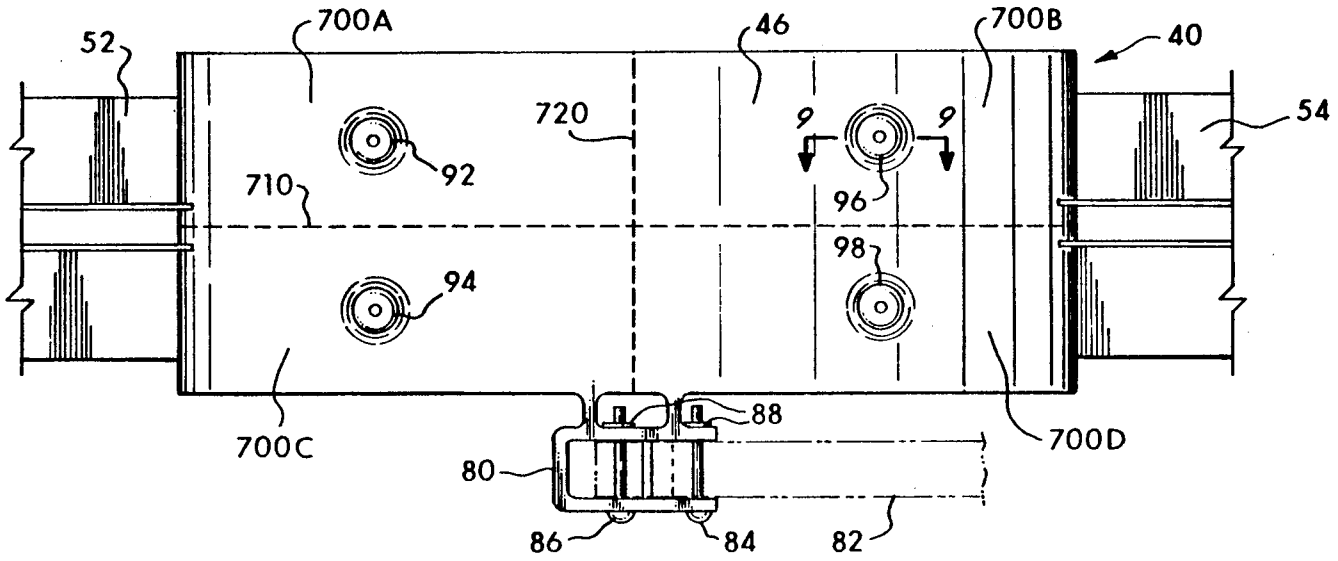
FIG. 7 is a top view of the antenna of FIG. 4.
Figure 9:
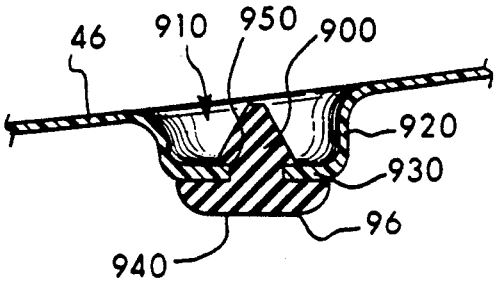
FIG. 9 is a cross sectional view of the base mounting feet of the antenna of the present invention.

Resilient base members 92–96 are inserted onto lower housing section 46 as shown in FIGS. 7–9. Resilient base members 92–96 are symmetrically spaced so housing 42 is stable in the lowered position, as shown in FIG. 8. As shown in FIG. 8, each base member 92, 94, 96, 98 is approximately located in the center of quadrants 700 A–700 D of the lower section 46 as indicated by the dotted lines 710, 720. This provides balanced loading of the antenna onto the roof of the vehicle to reduce movement or vibration of the antenna in the lowered traveling position. The two members 92 and 96 are forward of the centerline 710 and provide stability to the housing 42. In the event of RV roof 50 unevenness at least three members will fully support the housing against the roof. Otherwise, all four members engage the roof.

An alternative embodiment of the base members on the antenna housing is illustrated in FIG. 12. In this embodiment, the lower side 46 of the housing has three base members, 1200, 1210, 1220 inserted in a symmetrical fashion approximately centered in the portions formed by lines 1230, 1240, 1250. The use of three base members also provides balanced loading of the antenna in the lowered traveling position to reduce movement or vibration of the antenna relative to the roof of the vehicle. Member 1220 is positioned just in front of integral leveling block 80 to provide stability for the rear of housing 42. Members 1200 and 1210 are forward of centerline 1260 to positively seat and support the front half of the housing 42. The three members are in triangular relationship to each other and will also positively engage the roof 50 of the RV.

It is to be expressly understood that any plurality of two or more members could be utilized although the first and second embodiments are the least expensive to implement. In comparison with the SENSAR ® antenna which supports members 30 in the general location of members 94 and 98, the present invention provides two members forward of the housing centerline to positively seat the housing so as to prevent movement.

In either embodiment, the resilient base members are snapped into lower housing section, as shown in FIG. 9, by barb-shaped end portions 900 so no additional fasteners are necessary which add weight, cost and assembly time. As shown in FIG. 9, the bottom 46 of housing section 42 has a formed foot 910 with substantially perpendicular sides 920 and flat bottom 930. The member 96 has a button region 940 which abuts against bottom 930. In the center of the foot 910 is a formed hole 950 through which the bonded portion 900 enters and then engages. This "push-in" design saves costs in manufacturing. The base members are lower in height relative to the prior art antenna base members to further reduce the profile of the antenna in the lowered position. In the preferred embodiment, the low profile resilient base members and raised base mounting member raise the antenna to an overall height of about 2.25 inches in height. This further reduces the wind resistance of the antenna.

4. Low Profile Features of the Antenna

The decrease in the bend angle of wing tips 56, 58, the use of more than two compact base members 92–96 and the smaller size of leveling block 80 provide an antenna that more closely hugs the roof 50 so as to provide a lower profile in order to reduce the wind resistance of the antenna in the lowered position.

As shown in FIGS. 8 and 11, antenna 40, hugs the roof in the lowered position with an extremely low profile to reduce the wind resistance of the antenna as the vehicle is moved. In the preferred embodiment, antenna 40, in the lowered position, has a maximum height D1, at the center, above the vehicle roof of about 2.25 inches. In comparison, the prior art antenna of FIG. 1, in the lowered position has a height of about 3.06 inches above the roof of the vehicle and the prior art antenna of FIG. 2 extends about 3.83 inches above the roof of the vehicle when the antenna is lowered. The present invention has a maximum height improvement of 2.25. Another feature contributing to the lower profile of the antenna is the compact base members. The clearance D2 between the bottom of the antenna in the lowered position and the roof of the vehicle is about 0.25 inches. The clearance D3 between the antenna wings at the outer portion of the antenna housing has also been reduced to about 1.25 inches. Hence, the present invention causes the bottom of the housing to be closer to the RV roof than the wing tips are.

LOW PROFILE CHART

| | Present Invention | SENSAR | SIGNAL COMMANDER |
|---|---|---|---|
| D1 | 2.25 | 3.81 | 3.06 |
| D2 | 0.25 | 0.50 | 0.88 |
| D3 | 1.25 | 2.00 | 1.88 |
| D4 | 0.50 | 0.50 | 0.88 |
| D1:D2 | 9.00 | 7.62 | 3.48 |
| D4:D2 | 2.00 | 1.00 | 1.00 |
| D1:D4 | 4.5 | 7.62 | 3.48 |

The reduced angle 1100 of the wing tips 56 and 58 of the present invention maintains sufficient clearance D4 as shown in FIG. 11, to minimize the chattering of the wing tips on the RV roof. The angle of the wing tips also reduces the susceptibility to damage compared to the greater angle of the prior art antennas. The close hugging relationship provided by distances D1 and D2 mandate a shallower angle of 10°. Indeed, under the teachings of the present invention, the angle 1100 can be any suitable value between about 7° and 10°.

The ratio D1:D2 of the height D1 of the antenna housing and the clearing of the housing D2 is important in minimizing the overall profile of the antenna in the lowered position without causing damage to the roof of the vehicle. The present invention provides about a D1:D2 ratio in the range of about 9.00 or greater. Under the teachings of the present invention, a ratio of D4:D2 in the range of greater than about 2.00 is achieved. This provides minimum of wind resistance by hugging the housing closer to the roof without the antenna wing tips vibrating against the roof of the vehicle.

Further, base members 92–96 provide greater stability between the antenna and the roof of the recreational vehicle. This improved stability reduces the chattering effect of the wing tips as well. Also, integral leveling block 82 provides a stronger, lighter weight antenna as does the snap fitting of the housing sections 44, 46 together. Thus, the present invention provides an improved antenna for use on vehicles such as but not limited to recreational vehicles.

It is to be expressly understood that the claimed invention is not to be limited to the description of the preferred embodiment but encompasses other modifications and alterations within the scope and spirit of the inventive concept.

We claim:

1. An external low profile antenna for closely abutting the roof of a recreational vehicle when in a lowered position, said antenna comprising:

opposing outwardly extending antenna elements, each of said antenna elements terminating in a tip;

housing means for encapsulating at least a portion of said opposing antenna elements, said housing means including:

(a) an upper housing section;

(b) a lower housing section; and (c) means on said upper housing section and on said lower housing section for resiliently engaging said sections to securely fasten said upper housing section and said lower housing section together wherein said housing means further includes a substantially elliptically contoured shape having a maximum profile height of about 2.25 inches, wherein said means on said upper housing section for resiliently engaging said engaging means of said lower housing section includes a front surface on said upper housing section having slots formed therein and a rear surface on said upper housing section having tabs formed thereon; and said means on said lower housing section for resiliently engaging said engaging means of said upper housing section includes a front surface on said lower housing section having tabs formed thereon for engaging said slots of said upper housing section and a rear surface on said lower housing section having slots formed therein for engaging said tabs on said housing section;

the ratio of the distance from the top of said housing means in said lowered position to said roof to the distance from the bottom of said housing means to said roof forming a top ratio greater than 9, the ratio of the distance from the tip of said element to said roof to the distance from the bottom of said housing means to said roof in said lowered position forming a bottom ratio greater than 2 so as to provide said low profile antenna in close abutment to said roof.

2. The antenna of claim 1 wherein said housing means includes leveling block means for engaging an antenna support, wherein said leveling block means is integrally formed in said housing means.

3. The antenna of claim 2 wherein said leveling block means includes a substantially U-shaped bracket integrally molded to said housing means wherein said antenna support is engaged in said U-shaped bracket.

* * * * *